United States Patent [19]

Tarnay

[11] Patent Number: 4,665,471

[45] Date of Patent: May 12, 1987

[54] SEALED HEADLAMP

[75] Inventor: Denes Tarnay, Cleveland, Ohio

[73] Assignee: General Electric Company, Schenectady, N.Y.

[21] Appl. No.: 808,775

[22] Filed: Dec. 13, 1985

[51] Int. Cl.[4] ..... F21V 29/00

[52] U.S. Cl. ..... 362/267; 362/306

[58] Field of Search ..... 362/267, 306, 310, 311

[56] References Cited

U.S. PATENT DOCUMENTS

| | | | |
|---|---|---|---|
| 3,784,807 | 1/1974 | Boekkooi et al. | 362/267 |
| 3,898,451 | 8/1975 | Murphy et al. | 362/267 |
| 4,128,864 | 12/1978 | Brussee et al. | 362/306 |
| 4,240,131 | 12/1980 | Albrecht | 362/267 |
| 4,336,577 | 6/1982 | Hanson | 362/267 |
| 4,344,119 | 8/1982 | Bergot | 362/267 |
| 4,344,120 | 8/1982 | Bradley et al. | 362/267 |
| 4,425,606 | 1/1984 | Shanks et al. | 362/267 |
| 4,447,862 | 5/1984 | Shanks | 362/267 |
| 4,520,432 | 5/1985 | Mayer et al. | 362/267 |
| 4,544,998 | 10/1984 | Shanks | 362/267 |
| 4,563,730 | 1/1986 | Saito | 362/267 |

*Primary Examiner*—Raymond A. Nelli

*Attorney, Agent, or Firm*—J. F. McDevitt; Philip L. Schlamp; Fred Jacob

[57] ABSTRACT

An all glass sealed beam headlamp unit is disclosed having polygon shaped lens and reflector members which is capable of being alternately sealed together with an adhesive as well as being fusion sealed by reason of the sealing rim construction being employed. Specifically, the cooperating and opposing sealing rim surfaces of both members include planar sealing surfaces located at the outer periphery which extend longitudinally without interruption around all sides of said members along with rib elements projecting forwardly from the planar sealing surface at all corners of the lens member with said rib elements being located at the inner periphery of said lens member for physical abutment with inner edge of the planar sealing surface located on the reflector member at the corner locations.

3 Claims, 2 Drawing Figures

SEALED HEADLAMP

RELATED APPLICATION

In related patent application Ser. No. 804,553 filed Dec. 4, 1985 (LD 9257) and assigned to the assignee of the present invention, there is disclosed a fusion sealed glass lamp unit having rib elements protruding from the planar rim sealing surfaces of both lens and reflector members to improve the glass seal. Both of said rib elements and the planar sealing surfaces from which rib elements project are continuous and extend entirely around the sealing rim. The cooperation between said opposing elements produces a glass seal without void spaces which cause mechanical or hermetic defects.

BACKGROUND OF THE INVENTION

Rib elements located in the sealing rim region of a polygon shape all glass sealed beam headlamp are known to improve various characteristics of the hermetic seal formed when the lens and reflector members are thermally sealed together after assembly by melting the glass material. For example, there is disclosed in U.S. Pat. No. 4,128,864, which is assigned to the assignee of the present invention non-continuous rib elements projecting rearwardly from the back sealing surfaces of the individual lens and reflector members which resist deformation when the fusion seal is made. Continuous rib elements located on the front sealing surfaces of a polygon shape fusion sealed headlamp are also now employed in conventional manufacture whereupon a single rib element protrudes from the reflector member to physically engage the inner edge of the planar sealing surface located on the lens member to provide alignment when these lamp components are assembled for the heat sealing step.

On the other hand, discontinuous rib elements are now employed in the sealing rim region of an all glass polygon shaped headlamp unit when the seal between the lens and reflector members is accomplished with an adhesive. For example, there is disclosed in U.S. Pat. No. 4,544,998, also assigned to the assignee of the present invention, a plurality of rib elements extending forwardly from the front sealing surfaces of a reflector member and limited to corner locations which physically engage the inner edge of the planar sealing surface located on the lens member. As therein disclosed, said rib elements provide alignment means to position the lens and reflector members during the adhesive sealing step. A different type sealing engagement for adhesively sealed headlamp units of this general type is disclosed in U.S. Pat. No. 4,447,862, also assigned to assignee of the present invention. Corner rib elements project forwardly from the planar sealing surface of the lens member in said arrangement to physically engage the ends of discontinuous planar sealing surfaces located on the reflector member.

Such use of dissimilar sealing engagement means for this headlamp construction depending upon the sealing method being used understandably creates logistic problems for the lamp manufacturer as well as increases equipment costs to produce the different lamp parts. Additionally, rejection rates for the conventional pressed glass parts and the lamps produced therefrom are too high as a result of the warp, lack of alignment and void spaces being experienced in the finished glass seal during conventional lamp manufacture.

It would be desirable, therefore, to correct all of the above indicated drawbacks with a single headlamp construction utilizing lens and reflector members which are capable of being alternately sealed together with an adhesive as well as fusion sealed together.

It is another important object of the present invention to modify the sealing rim region of a polygon shaped glass sealed beam headlamp in such a manner that still other steps in the overall lamp manufacture are benefited than simply achieving in the desired hermetic seal in the assembled lamp construction such as a sealing rim profile on the individual lens and reflector members enabling said lamp components to be initially pressed with greater reliability.

SUMMARY OF THE INVENTION

It is now been discovered that a particular sealing rim profile on the individual lens and reflector members being employed effectively avoids the aforementioned drawbacks when either an adhesive seal or a fusion seal method of assembly takes place on conventional lamp manufacturing equipment. More particularly, a novel cooperation is achieved between rib elements and the planar sealing surfaces in the present lamp construction which improves the hermeticity and mechanical strength of the glass seal whether effected with adhesive bonding or fusion of the glass material. The principal structural changes responsible for said improvement comprise a removal of the rib element from the reflector member to corner locations on the lens member for cooperative sealing engagement with the inner edge of a continuously extending planar surface located on the outer rim periphery of said reflector member. Said improved all glass sealed beam headlamp thereby comprises polygon shaped lens and reflector members with cooperating and opposing sealing rim surfaces capable of being alternatively sealed together with an adhesive as well as being fusion together and characterized by planar sealing surfaces located at the outer periphery of each member which extend longitudinally without interruption around all sides of both members along with rib elements projecting forwardly from the planar sealing surface at all corners of said lens member, said rib elements being located at the inner periphery of said lens member and physically abutting with the inner edge of the planar sealing surface located on said reflector member at said corner locations. In one preferred embodiment, said improved lamp construction is of a rectangular shape utilizing a lens member which includes optical prism elements disposed on its inner surface such as now commonly employed in automotive headlamps.

DESCRIPTION OF THE PREFERRED EMBODIMENTS

Figure 1:
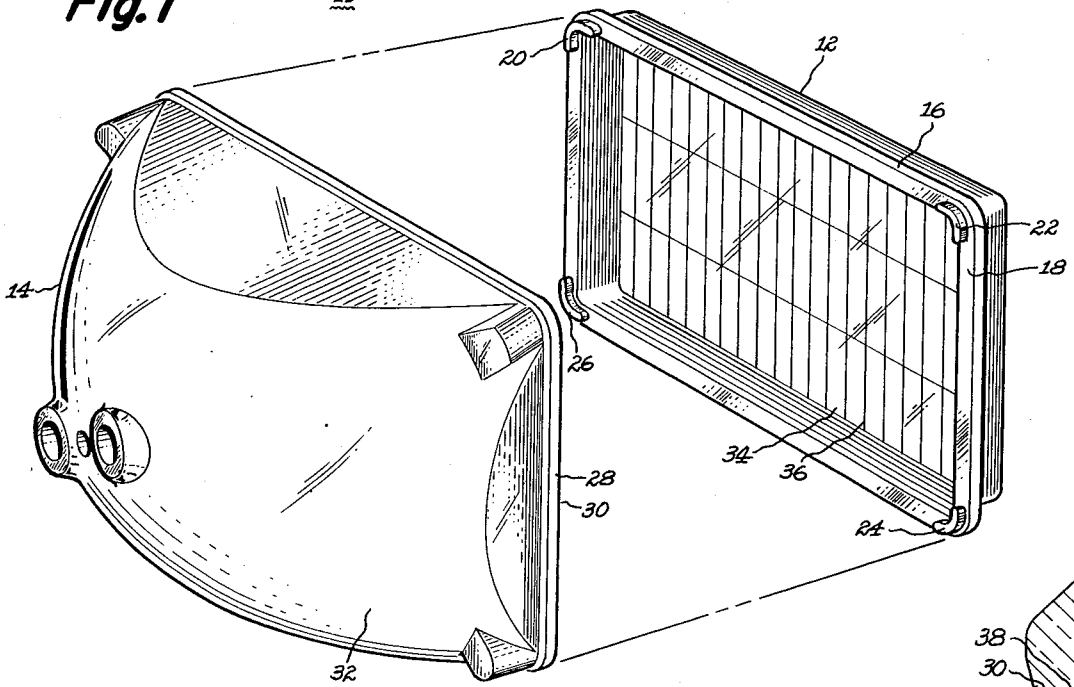
FIG. 1 is a perspective view, partially in cross-section, of an improved rectangular shaped automotive headlamp construction according to the present invention prior to sealing the lens and reflector members together.

Referring to the drawings, there is shown in FIG. 1 a rectangular-shaped all glass sealed beam lamp unit 10 which includes a rectangular-shape lens member 12 and a rectangular shaped pressed glass reflector member 14 prior to sealing together either with a conventional adhesive or by melting the sealing rims together. Glass member 12 includes a sealing rim 16 located at the outer periphery of said member which extends longitudinally without interruption around all sides and further includes a planar sealing surface 18. A plurality of rib elements 20, 22, 24 and 26 are disposed at the corner locations of said lens member and project forwardly from said planar sealing surface 18 so as to physically engage the sealing rim region of the reflector member 14 when these lamp components are assembled together. Said reflector member 14 includes a complimentary sealing rim 28 having a planar sealing surface 30 located at its outer periphery and sized to accommodate fitting the rib elements of the lens member inside corresponding corners. As can be further noted from said drawing, the reflector member 14 further includes a parabolic shaped cavity 32 whereas said lens member 12 further includes an inner surface 34 having representative prism elements 36 located thereon.

Figure 2:
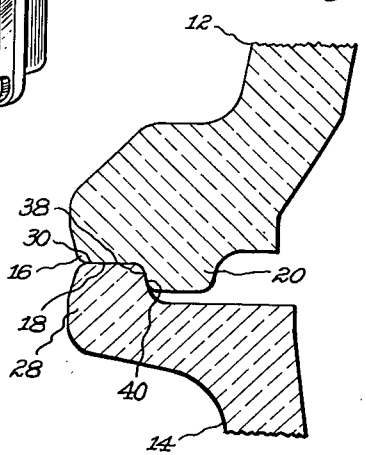
FIG. 2 is a cross-sectional view of the sealing rim region for the headlamp depicted in the FIG. 1 embodiment which illustrates the cooperating rib elements and sealing surfaces in greater detail.

In FIG. 2 there is shown in cross-section, a portion of the sealing rim regions for the above described embodiment after being assembled together in the customary manner but prior to forming a hermetic seal therebetween. Accordingly, the same numerals are employed in said FIG. 2 drawing to identify common structural elements previously described in the FIG. 1 drawing. It can first be noted in said more detailed configuration of the present sealing means that cooperative and opposing engagement of the individual planar sealing surfaces 18 and 30 takes place as well as a direct physical abutment occuring at the corner locations between opposing side edges 38 and 40 of rib element 20 and sealing rim 28, respectively. Surprisingly, said direct physical abutment between opposing side edges of the rib elements located on the lens member and the planar sealing surface located on the reflector member avoids forming voids in the sealing rim region when the assembled members are thereafter fusion sealed together. Adoption of the presently modified lens and reflector sealing engagement means further promotes greater dimensional reliability when these lamp parts are press molded as compared with the prior art configurations.

While a preferred embodiment of the present headlamp unit has been illustrated, various further modifications will become apparent to persons skilled in the art without departing from the true spirit and scope of the present invention. For example, it has been shown in the illustrated embodiment that the rib elements project a lesser distance from the planar sealing surface of the lens member than the projection distance of the planar sealing surface on the reflector member so as to provide a reservoir cavity in the assembled construction which can serve as a reservoir for excess adhesive if these lamp parts are adhesively bonded together. It is within contemplation, therefore, to incorporate still further adhesive reservoir cavities in the present sealing surface construction such as disclosed in the aforementioned 4,447,862 patent. Likewise, it is also within contemplation to employ still further anti-warp rib elements in the present sealing surface construction such as disclosed in the also previously mentioned 4,128,864 patent. Accordingly, the scope of the present invention is limited only by the following claims:

I claim:

1. An all glass permanently sealed beam headlamp having polygon shaped lens and reflector members with cooperating and opposing sealing rim surfaces capable of being sealed together with one of an adhesive and fusion seal and characterized by flat planar sealing surfaces located at the outer periphery of each member which extend longitudinally without interruption around all sides of both members along with rib elements projecting forwardly from the planar sealing surface and limited to all corners of said lens member, said corner rib elements being located at the inner periphery of said lens member and physically abutting with the inner edge of the planar sealing surface located on said reflector member at said corner locations and said corner rib elements after joinder between said lens and reflector members extending below the flat planar sealing surface on said reflector member to project a lesser distance from the planar sealing surface on said lens member than the projection distance of the planar sealing surface on said reflector member.

2. A headlamp as in claim 1 having a substantially rectangular configuration.

3. A headlamp as in claim 1 wherein said lens member includes optical prism elements.

* * * * *